US011390493B2

(12) United States Patent
Raines, Jr. et al.

(10) Patent No.: US 11,390,493 B2
(45) Date of Patent: Jul. 19, 2022

(54) SAFETY LATCH FOR A HOOK

(71) Applicant: Columbus McKinnon Corporation, Getzville, NY (US)

(72) Inventors: Troy Allen Raines, Jr., Soddy Daisy, TN (US); Luke James Cox, Flintstone, GA (US)

(73) Assignee: Columbus McKinnon Corporation, Getzville, NY (US)

( * ) Notice: Subject to any disclaimer, the term of this patent is extended or adjusted under 35 U.S.C. 154(b) by 46 days.

(21) Appl. No.: 16/908,802

(22) Filed: Jun. 23, 2020

(65) Prior Publication Data

US 2021/0395048 A1 Dec. 23, 2021

(51) Int. Cl.
*B66C 1/36* (2006.01)

(52) U.S. Cl.
CPC ..... *B66C 1/36* (2013.01)

(58) Field of Classification Search
CPC .... B66C 1/00; B66C 1/10; B66C 1/22; B66C 1/34; B66C 1/36; B63B 21/58
See application file for complete search history.

(56) References Cited

U.S. PATENT DOCUMENTS 1,489,509 A * 4/1924 Roberts ..... B66C 1/36 294/82.19
2,835,013 A * 5/1958 Thompson ..... B66C 1/36 294/82.19
2,905,997 A * 9/1959 Ramskill ..... B66C 1/36 294/82.22
3,501,817 A * 3/1970 Bambenek ..... B66C 1/36 294/82.19
3,575,458 A 4/1971 Crook, Jr. et al.
4,018,469 A * 4/1977 Stoops ..... B66C 1/36 294/82.2
4,193,627 A * 3/1980 Cranston ..... B66C 1/36 294/82.1
4,440,432 A * 4/1984 Goris ..... B66C 1/36 24/599.8

(Continued)

FOREIGN PATENT DOCUMENTS

| | | |
|---|---|---|
| FR | 2108846 A | 5/1972 |
| GB | 499245 A | 1/1939 |
| JP | S58 34875 U | 3/1983 |

OTHER PUBLICATIONS

European Search Report dated Feb. 18, 2022.

*Primary Examiner* — Stephen A Vu
(74) *Attorney, Agent, or Firm* — Phillips Lytle LLP; David L. Principe

(57) ABSTRACT

A hook assembly including a spring-biased safety latch that provides for installation of the latch onto the hook without spring tension. A fastener is configured to slide along an elongate slot when the latch is moved in translatory motion relative to the fastener. The fastener is configured to be inserted into the assembly in a first position while the tension on a biasing member is released. The first position is configured to allow the latch to rotate inward past the tip of the hook. The fastener is configured to move into a second position where it engages with a nut 53 that when installed is positioned in the portion and blocked by at least one shoulder such that the fastener is no longer able to slide in the slot preventing translator motion of the latch relative to the fastener.

18 Claims, 10 Drawing Sheets

(56) References Cited

U.S. PATENT DOCUMENTS

| | | | | |
|---|---|---|---|---|
| 5,899,512 | A * | 5/1999 | Wiklund | B66C 1/36 294/82.19 |
| 8,014,656 | B2 * | 9/2011 | Woodman | B63B 32/77 396/25 |
| 2010/0289284 | A1 * | 11/2010 | Toon | B66C 1/36 294/82.19 |
| 2015/0353327 | A1 * | 12/2015 | Hoover | F16B 45/02 294/82.2 |

* cited by examiner

SAFETY LATCH FOR A HOOK

TECHNICAL FIELD

The present invention relates generally to the field of hoists and rigging equipment, and more particularly to a hook assembly including a safety latch.

BACKGROUND ART

The Occupation Health and Safety Administration ("OSHA") and the American Society of Mechanical Engineers ("ASME") require latches to be on hooks used in material handling applications such as hooks used with cranes and hoists. Latches are frequently damaged in the field. There is a need for an improved design that is advantageous for manufacturing and for end users.

BRIEF SUMMARY OF THE INVENTION

The present invention meets the above described need. With parenthetical reference to the corresponding parts, portions or surfaces of the disclosed embodiment, merely for the purposes of illustration and not by way of limitation, in one embodiment the present invention provides a hook assembly (10) with a hook (11) having a body portion (13) with a first end (16) and a second end (19). The body portion (13) extends along a curve to a tip (43) disposed at the second end (19). The body portion (13) has a neck portion (31) disposed in spaced apart relation to the tip (43) such than an opening (46) is formed between the tip (43) and the neck portion (31). The neck portion (31) has an opening formed therein. A latch (40) has a first end (61) and a second end (62) disposed opposite from the first end (61). The first end (61) has a pair of opposed members (63, 66) extending therefrom and disposed in spaced apart facing relation. At least one of the opposed members (63,66) has an elongate slot (50) formed therein. The opposed member (63, 66) has a portion surrounded by at least one wall forming a shoulder (56). The portion is disposed adjacent to the slot (50). The portion is configured to receive a nut (53). The latch (40) is pivotally connected to the neck portion (31) of the hook (11). A biasing member (49) is configured to bias the latch (40) in a closed position such that the second end (62) of the latch (40) engages with the tip (43) of the hook (11) to close the opening between the tip (43) and the neck portion (31). A fastener (37) extends through the openings in the opposed members (63, 66) of the latch (40) and through the opening in the neck portion (31). The fastener (37) is configured to slide along the elongate slot (50). The fastener (37) is configured to be inserted into the assembly in a first position while the tension on the biasing member (49) is released. The first position is configured to allow the latch (40) to rotate inward past the tip (43) of the hook (11). The fastener (37) is configured to move into a second position where it engages with a nut (53) that when installed is positioned in the portion and blocked by the at least one shoulder (56) such that the fastener (37) is no longer able to slide in the slot (50).

In another aspect, the shoulder (56) is formed by a recessed portion (69).

The assembly (10) may further comprise a pair of ears (17, 18) extending from the hook (11).

In another aspect, the ears (17, 18) may be disposed in spaced apart facing relation.

In another aspect, the ears (17, 18) having openings defined therein sized to receive a pin configured to attach the hook (11) to a load.

In another aspect, opposed members (63, 66) on the latch (40) have a shoulder (56) formed on the outer wall at a midportion of the slot (50).

In yet another aspect, one of the opposed members (63, 66) has a round opening (106) defined therein.

In another aspect, the outer wall of the opposed member (63, 66) with the round opening (106) may have a shoulder (160) formed therein.

In yet another aspect, the neck portion (31) may have a narrow portion with an opening defined therein. The opening may be configured to align with the openings in the opposed members (63, 66) on the latch (40).

In another aspect, the biasing member (49) may be a coil spring disposed around the fastener (37) that attaches the latch (40) to the neck portion (31) of the hook (11).

DESCRIPTION OF THE PREFERRED EMBODIMENTS

Figure 1:
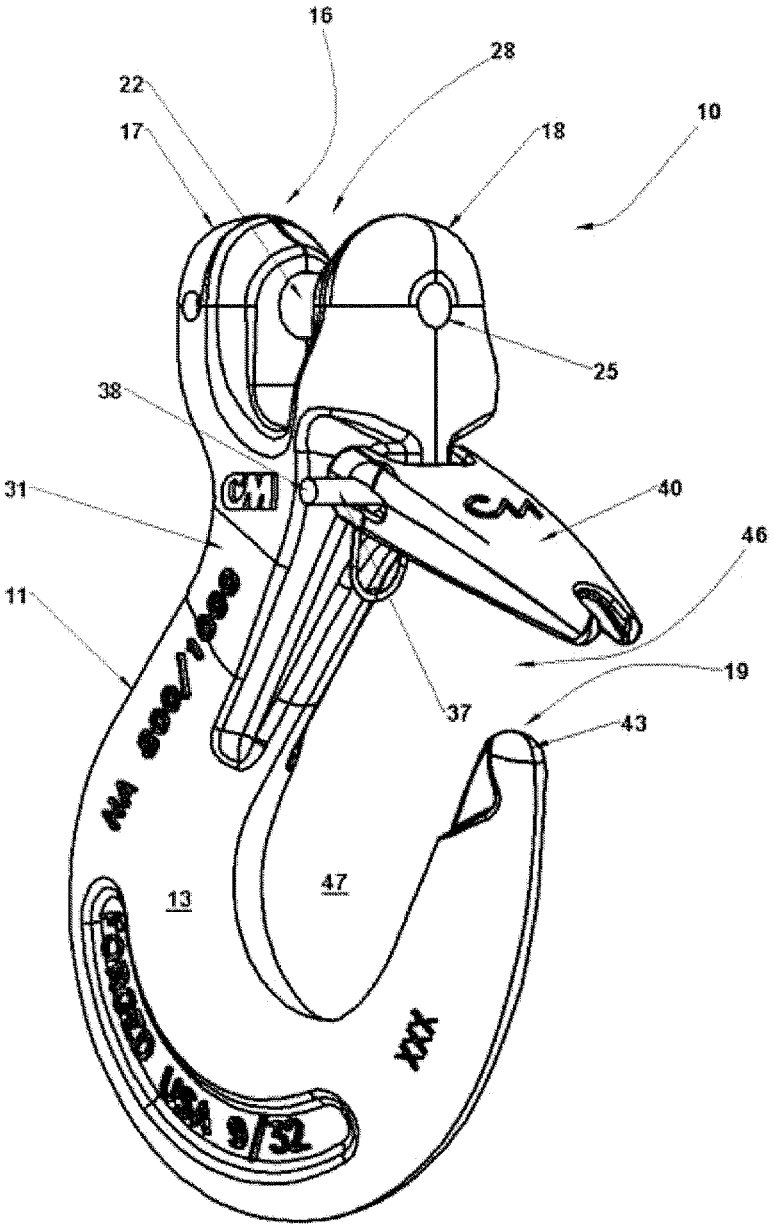
FIG. 1 is a perspective view of one embodiment of the assembly of the present invention shown during installation of the latch.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, debris, etc.) together with the specification, and are to be considered a portion of the entire written description of this invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or of rotation, as appropriate.

Referring generally to FIGS. 1-9, and initially to FIG. 1 thereof, this invention provides a hook assembly 10 with a hook 11 having a body 13 with a first end 16 and a second end 19. The hook 11 may be formed of a high strength material such as steel or the like for use in industrial applications for connecting a load to a crane, hoist or the like. The first end 16 may be provided with a pair of spaced apart, ears 17 and 18 that terminate at the first end 16 of the body 13. The ears 17 and 18 may be configured in facing relation and may be provided with openings 22 and 25 defined therein. The openings 22, 25 receive a pin (not shown) for connecting the hook assembly 10 to a wire or rope as described below. The ears 17 and 18 form a U-shaped opening 28 therebetween. The ears 17 and 18 are configured in this manner for attaching the hook assembly 10 to a wire rope or cable attached to a crane or hoist. The ears 17 and 18 extend upward from a neck portion 31 of the body 13.

The neck portion 31 may be provided with an opening for receiving a fastener 37. The fastener 37 pivotally attaches a latch 40 to the neck portion 31 as will be described in detail herein. The body 13 extends along a curve until it reaches the second end 19. The second end 19 terminates in a tip 43. An opening 46 is formed between the tip 43 and the neck portion 31. The opening 46 leads to a U-shaped space 47 defined by the body 13 of the hook 11.

The latch 40 is pivotally attached to the neck portion 31. A biasing member 49 (FIGS. 3-4) such as a spring or the like biases the latch 40 in the counterclockwise direction.

In FIG. 1, the latch 40 is shown in its initial position where the tension on the biasing member 49 is released. In this position, the fastener 37 such as a screw, bolt or the like can be inserted through aligned openings in the latch 40 and the neck portion 31. As shown, the free end 38 or the end opposite the head 39 of the fastener 37 is shown extending through one of the openings in the latch 40. The design provides for assembly of most of the components without spring tension and without having to position the latch 40 in its final installed position.

Figure 2:
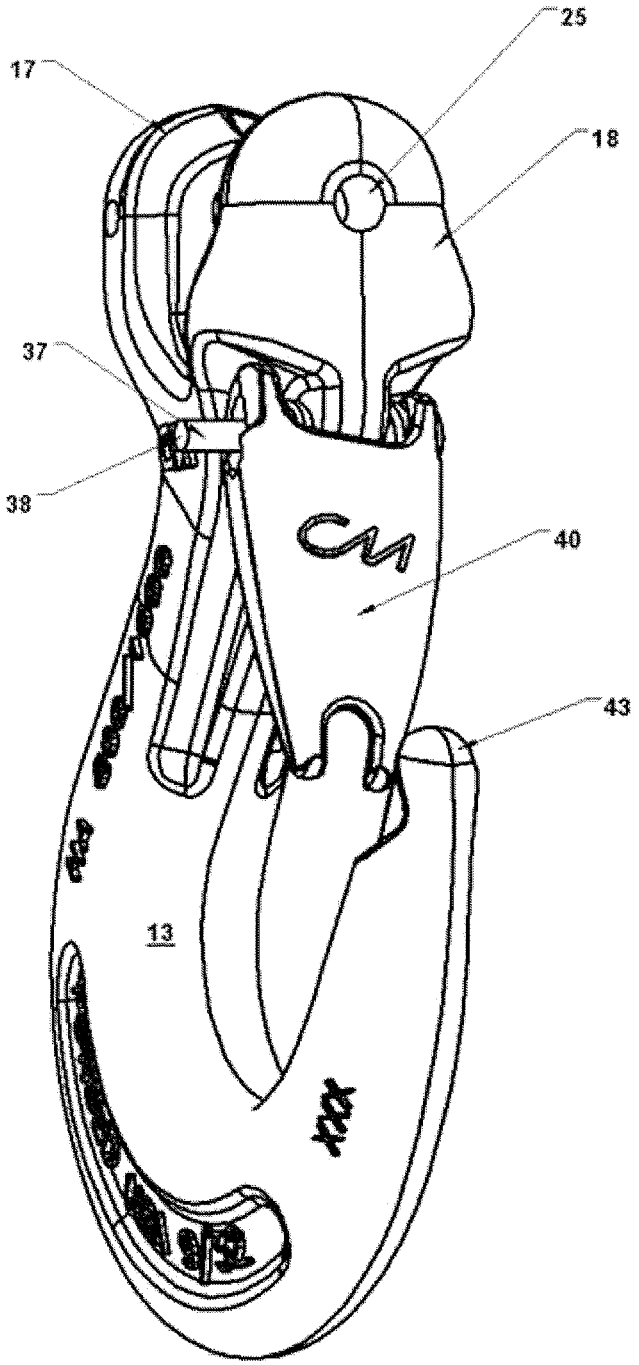
FIG. 2 is a perspective view of the assembly of FIG. 1 shown in a middle position.

Turning to FIG. 2, the slot described in further detail herein provides for sliding the fastener 37 forward in the slot to reduce the length of the portion of the pivoting latch 40 that extends beyond the fastener 37. As a result, in this position of fastener 37 in the slot, the latch 40 is capable of rotating past the tip 43. FIG. 2 shows a mid-position where the latch 40 has been rotated past the tip 43 and extends into the U-shaped space 47 formed by the hook H.

Figure 3:
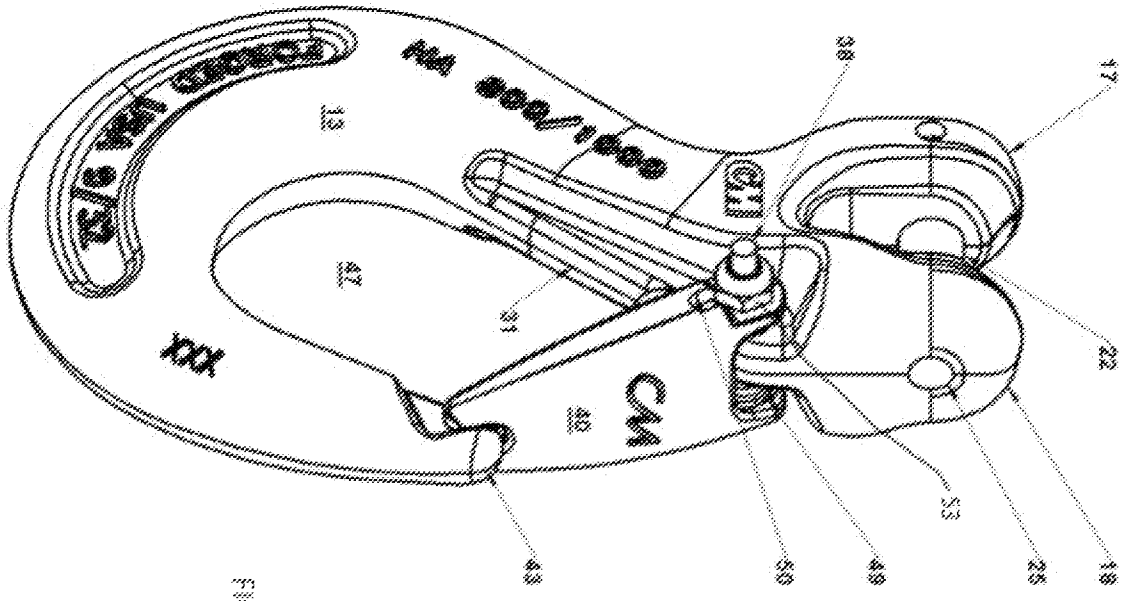
FIG. 3 is a first perspective view of the assembly of FIG. 1 shown in the installed position.

In FIG. 3, the fastener 37 is pushed backward in the slot 50 and a nut 53 is attached to the fastener 37. As will be described in greater detail herein, once the nut 53 is attached to the fastener 37, the fastener 37 is no longer able to slide within the slot 50 because the nut 53 bears against a shoulder 56 (best shown in FIGS. 5-6) formed near the opening for the fastener 37. Accordingly, the position shown in FIG. 3 corresponds to the final installed position of the latch 40. The final installed position corresponds to the position where the latch 40 is under spring tension and is engaged with the tip 43 of the hook 11. When the latch 40 is installed in the hook assembly 10, it provides a bias in the normally closed position such that the latch 40 extends between the neck portion 31 and the tip 43 and is held against the tip 43 by the force of the biasing member 49. The latch 40 is configured to rotate inward into the space 47 created by the hook 11 such that the hook 11 can be connected to an attachment member on a load. Once the attachment member passes by the latch 40 and enters the space 47 inside the hook 11, the latch 40 rotates under the force of the biasing member 49 until it engages with the tip 43. In this position the latch 40 is in the closed position and the load is secured to the hook assembly 10.

Figure 4:
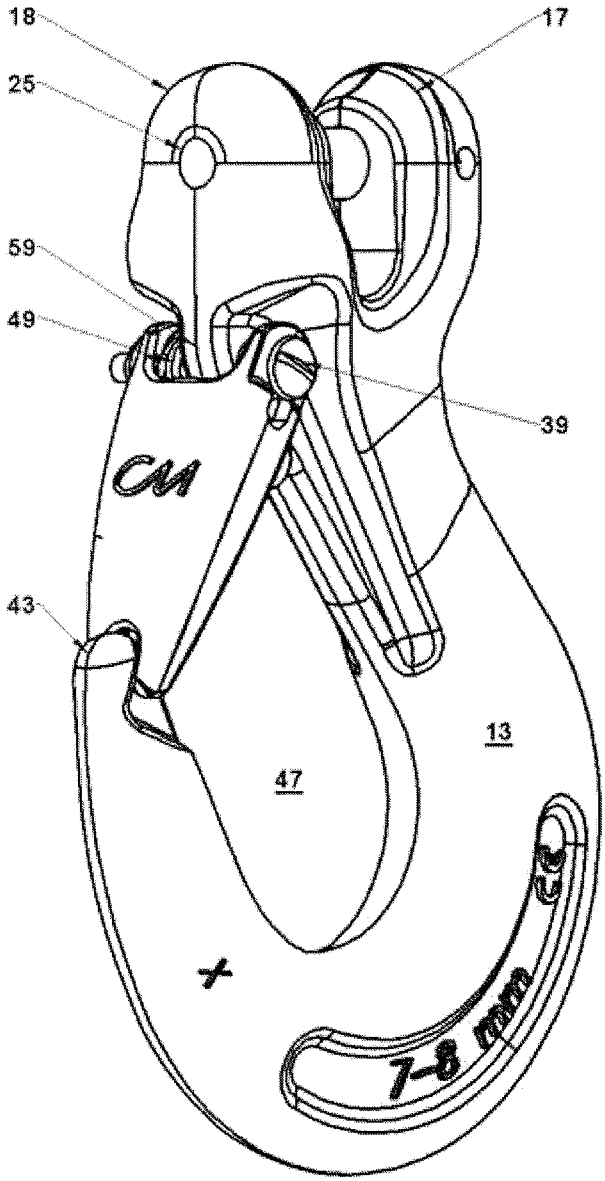
FIG. 4 is a second perspective view of the assembly of FIG. 1 shown in the installed position.

In FIG. 4, the assembly is shown from the opposite side such that the head 39 of the fastener 37 is visible. As shown the neck portion 31 may be provided with a narrow portion 59 containing the opening for receiving the fastener 37.

Figure 5:
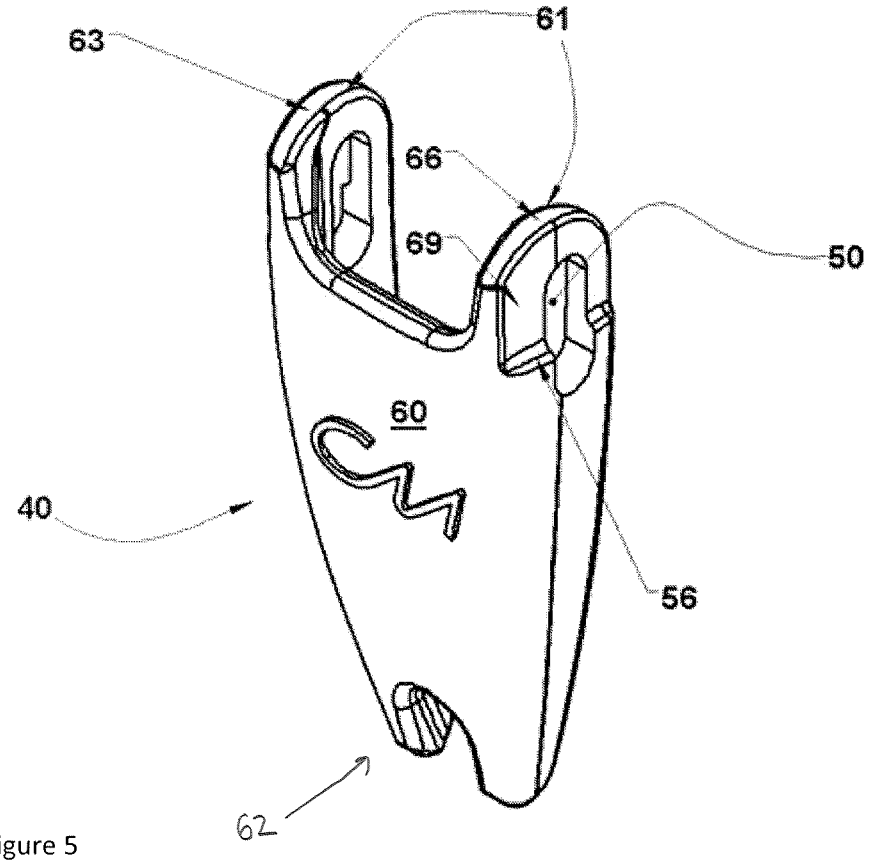
FIG. 5 is a perspective view of one embodiment of the latch.
Figure 6:
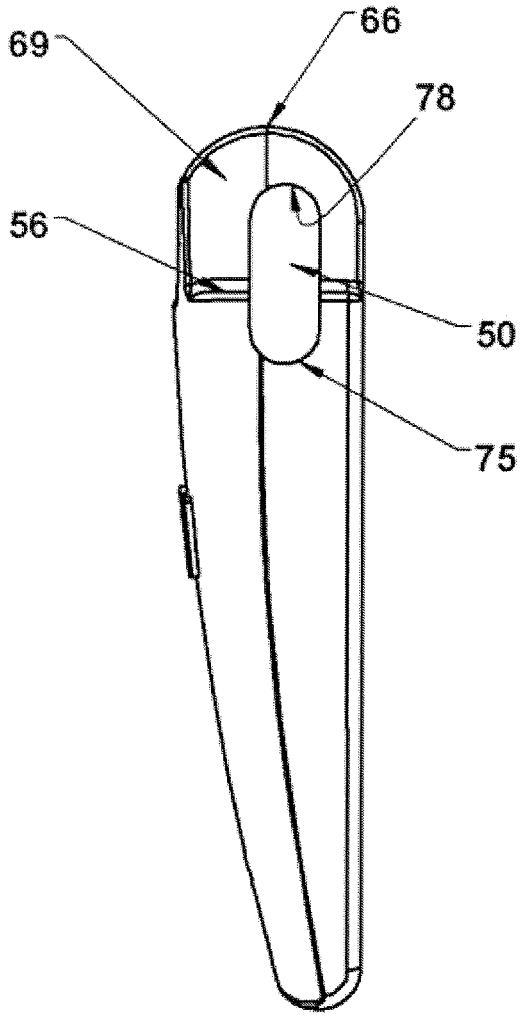
FIG. 6 is a right side elevational view of the latch shown in FIG. 5.

Turning to FIGS. 5-6, a detailed view of one embodiment of the latch 40 is shown. The latch 40 may be provided with a body 60 having a first end 61 and a second end 62 disposed opposite from the first end 61. A pair of opposed members 63, 66 are disposed in spaced apart facing relation at the first end 61. In FIG. 5, each opposed member 63, 66 is provided with an opening formed in the shape of an elongate slot 50. The outside surface of the opposed member 63, 66 may be provided with a recessed surface 69 that forms the shoulder 56. The slot 50 extends beyond the shoulder 56. With reference to the orientation of FIG. 6, when the latch 40 is being installed on the hook assembly 10, the fastener 37 slides to the bottom 75 of the slot 50 so that the end of the latch 40 can rotate past the tip 43 of the hook 11. Once the end of the latch 40 rotates past the tip 43 into the space 47 inside the hook 11, the fastener 37 can be slid into the top 78 of the slot 50. In this position, the nut 53 can be attached to the end of the fastener 37. In the installed position, the nut 53 engages with the shoulder 56 formed on the outside of the opposed member 63, 66 such that the fastener 37 is captured at the top 78 of the slot 50 and can no longer move to the bottom 75 of the slot 50. Accordingly, when the latch 40 rotates the end of the latch 40 engages with the tip 43 to form a lock that prevents the cable or rope attached to the load from exiting from the space 47 inside the hook 11. The embodiment in FIG. 5 includes matching slots 50 on both opposed members 63, 66 as shown in FIG. 6 which provides for installation of the fastener 37 from either side.

Figure 7:
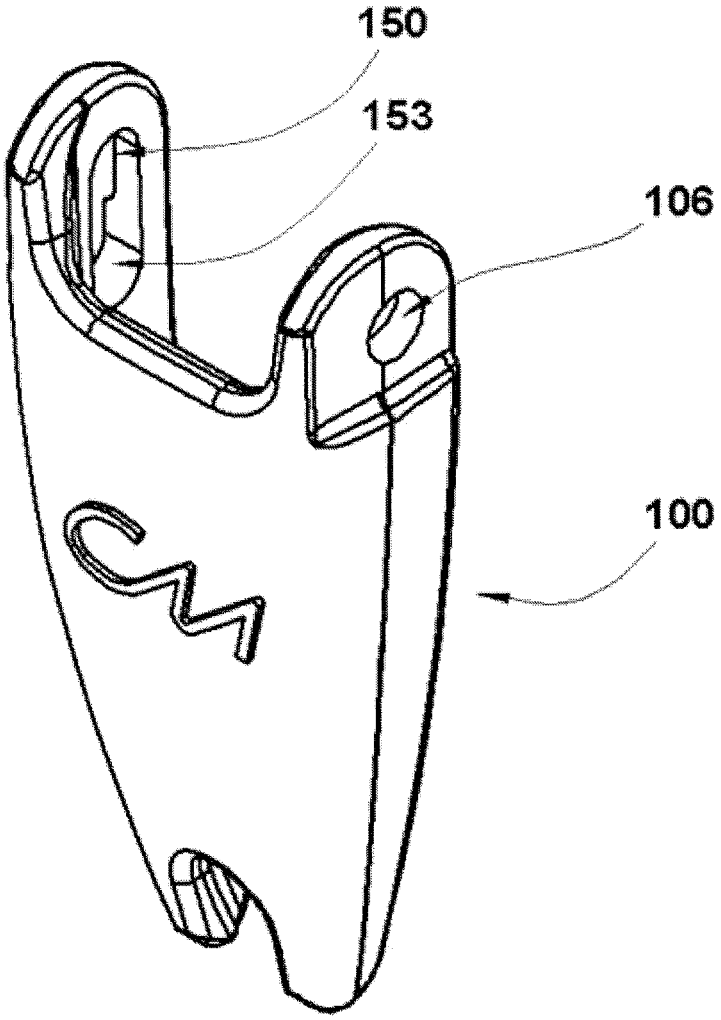
FIG. 7 is a perspective view of an alternate embodiment of the latch.
Figure 8:
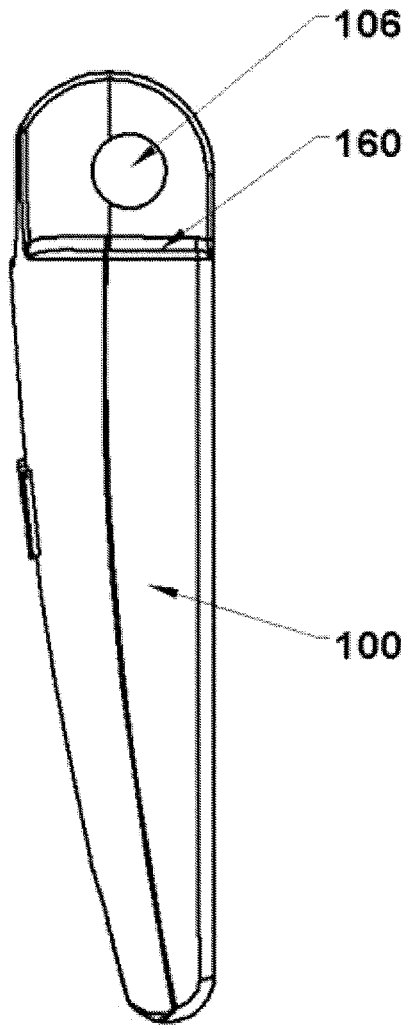
FIG. 8 is a right side elevational view of the latch shown in FIG. 7
Figure 9:
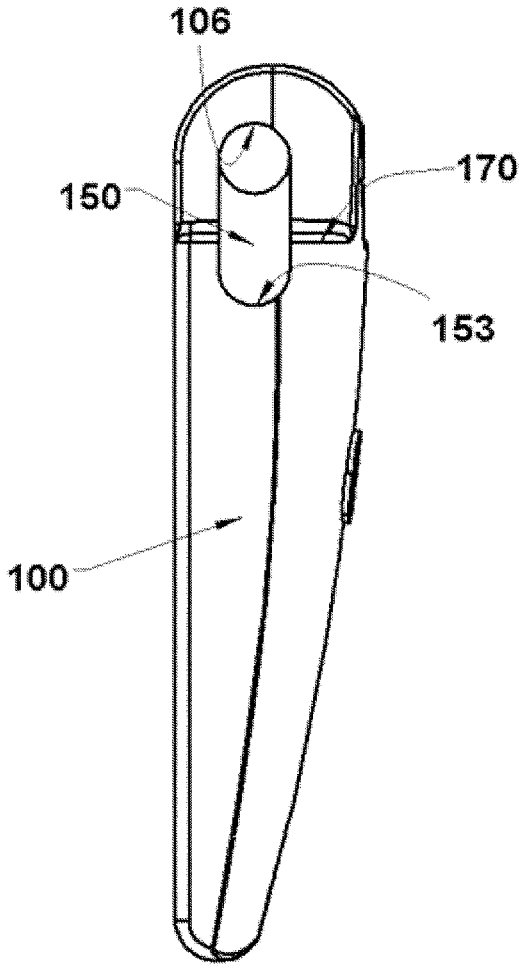
FIG. 9 is a left side elevational view of the latch shown in FIG. 7.

In FIGS. 7-9, an alternate embodiment of the latch is shown. Latch 100 has a slot 150 on one side and a round opening 106 on the opposite side. The fastener 37 is installed with the head 39 on the side of the round opening 106. The opposite end 38 of the fastener 37 that receives the nut 53 is disposed in the side with the elongated slot 150. The slot 150 provides for moving the shaft of the fastener 37 toward the bottom 153 of the slot 150 to allow the latch 100 to rotate past the tip 43 into the space 47 inside the hook 11. Once the latch 100 is in position inside the space 47, the nut 53 can be attached to the end of the fastener 37. As shown in FIG. 8, the round opening 106 has a shoulder 160 disposed in spaced apart relation below the bottom of the opening 106. In FIG. 9, a shoulder 170 is disposed at a position between the two ends of the slot 150. When the nut 53 is attached to the fastener 37, the nut 53 bears against the shoulder 170 which prevents the shaft of the fastener 37 from moving toward the bottom 153 of the slot 150. Accordingly, the latch 100 and biasing member 49 can be connected to the hook assembly 10 with the latch 100 positioned outside the hook 11 and without spring tension. Once the latch 100 is connected to the neck portion 31 of the hook 11, the latch 100 can be rotated into position inside the hook 11 against the force of the biasing member 49 and the nut 53 can be placed on the end of the fastener 37.

Figure 10:
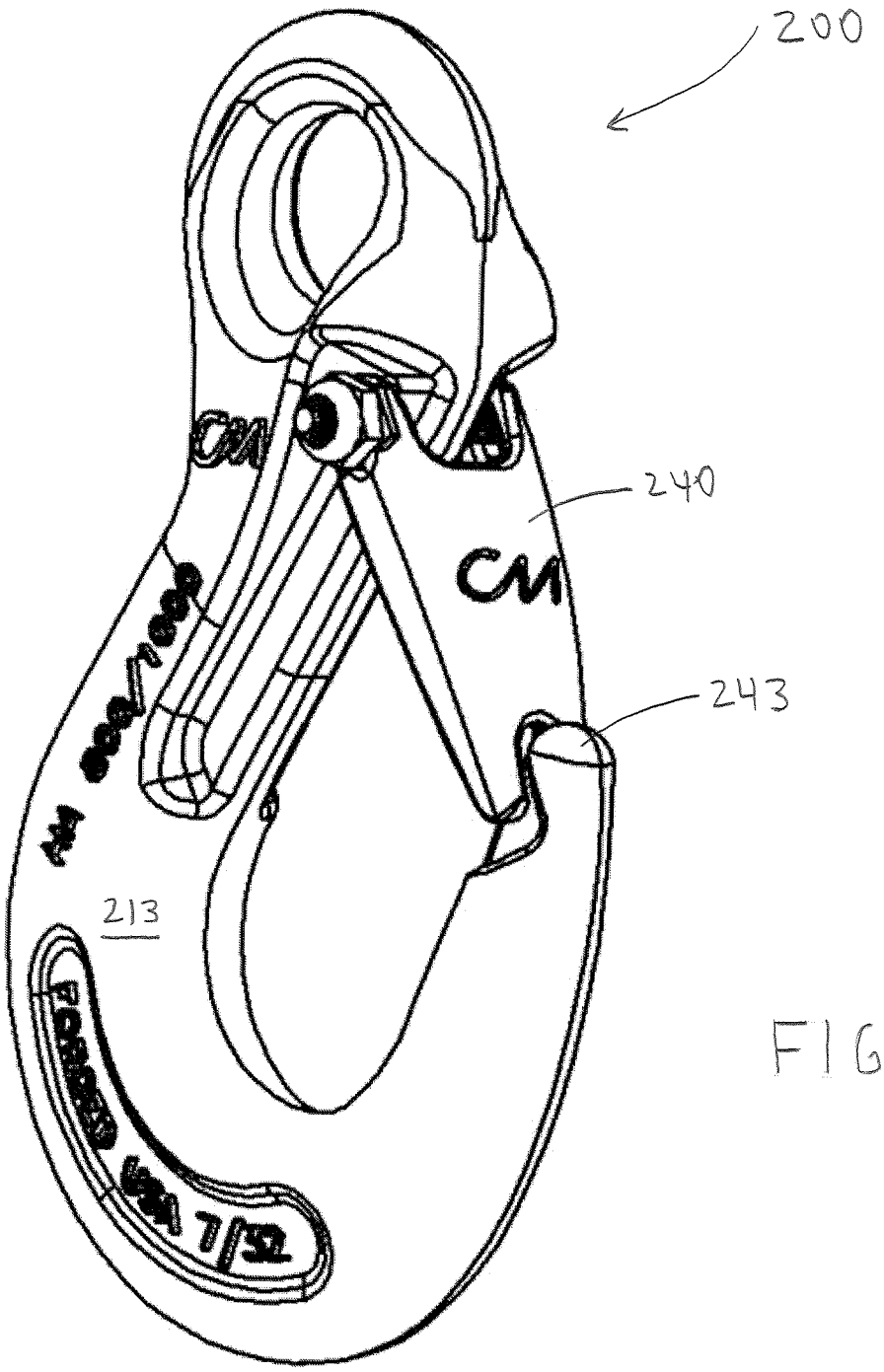
FIG. 10 is a perspective view of an alternate embodiment of the present invention shown in connection with an eye hook.

Turning to FIG. 10, an alternate embodiment of the invention shows a latch 240 of the present invention installed on an eye hook 200. The body 213 extends to a tip 243. The latch 240 is constructed in the same manner as the embodiment described above and may be installed without spring tension in the same manner as the embodiment described above. Accordingly, the latch construction of the present invention may be used with almost any type of hook as will be evident to those of ordinary skill in the art based on this disclosure.

The present invention contemplates that many changes and modifications may be made. Therefore, while the presently-preferred form of the safety latch for a hook has been shown and described, and several modifications and alternatives discussed, persons skilled in this art will readily appreciate that various additional changes and modifications may be made without departing from the spirit of the invention, as defined and differentiated by the following claims.

The invention claimed is:

1. A hook assembly, comprising:

a hook having a body portion with a first end and a second end, the body portion extending along a curve to a tip disposed at the second end, the body having a neck portion disposed in spaced apart relation to the tip such than an opening is formed between the tip and the neck portion, the neck portion having a opening formed therein;

a latch having a first end and a second end disposed opposite from the first end, the first end having a pair of opposed members disposed in spaced apart facing relation, at least one of the opposed members having an elongate slot formed therein, the opposed member having a portion surrounded by at least one wall, the portion disposed at one end of the slot, the portion configured to receive a nut, the latch pivotally connected to the neck portion of the hook;

a biasing member configured to bias the latch in a closed position such that the second end of the latch engages with the tip of the hook to close the opening between the tip and the neck portion;

a fastener extending through the openings in the opposed members of the latch and through the opening in the neck portion, the fastener configured to slide along the elongate slot when the latch is moved in translatory motion relative to the fastener;

wherein the fastening member is configured to be inserted into the assembly in a first position while the tension on the biasing member is released, the first position configured to allow the latch to rotate inward past the tip of the hook, the fastening member configured to move into a second position where it engages with a nut that when installed is positioned in the portion and blocked by the at least one wall such that the fastener is no longer able to slide in the slot preventing translatory motion of the latch relative to the fastener.

2. The assembly set forth in claim 1, wherein at least one shoulder is formed adjacent to a recessed portion.

3. The assembly set forth in claim 1, further comprising a pair of ears extending from the hook.

4. The assembly set forth in claim 3, wherein the ears are disposed in spaced apart facing relation.

5. The assembly set forth in claim 4, wherein the ears have openings defined therein for receiving a pin configured to attach the hook to a load.

6. The assembly set forth in claim 1, wherein both of the opposed members on the latch have an elongate slot defined therein.

7. The assembly set forth in claim 6, wherein both of the opposed members have a shoulder formed on the outer wall at a midportion of the slot.

8. The assembly set forth in claim 1, wherein one of the opposed members on the latch has a round opening defined therein.

9. The assembly set forth in claim 8, wherein the outer wall on the opposed member with the round opening has a shoulder formed thereon.

10. The assembly set forth in claim 1, wherein the neck portion has a narrow portion with an opening defined therein, the opening configured to align with the openings in the opposed members on the latch.

11. The assembly set forth in claim 1, wherein the biasing member is a coil spring disposed around the fastener that attaches the latch to the neck portion of the hook.

12. A hook assembly, comprising:

a hook having a body portion with a first end and a second end, the body portion extending along a curve to a tip disposed at the second end, the body having a neck portion disposed in spaced apart relation to the tip such than an opening is formed between the tip and the neck portion, the neck portion having a opening formed therein;

a latch having a first end and a second end disposed opposite from the first end, the first end having a pair of opposed members disposed in spaced apart facing relation, at least one of the opposed members having an elongate slot formed therein, the opposed member having a shoulder defined therein, the shoulder disposed at a midportion of the slot, the shoulder configured to engage with a nut, the latch pivotally connected to the neck portion of the hook;

a biasing member configured to bias the latch in a closed position such that the second end of the latch engages with the tip of the hook to close the opening between the tip and the neck portion;

a fastener extending through the openings in the opposed members of the latch and through the opening in the neck portion, the fastener configured to slide along the elongate slot when the latch is moved in translatory motion relative to the fastener;

wherein the fastening member is configured to be inserted into the assembly in a first position while the tension on the biasing member is released, the first position configured to allow the latch to rotate inward past the tip of the hook, the fastening member configured to move into a second position where it engages with a nut that when installed is blocked by the shoulder such that the fastener is prevented from sliding along the slot preventing translatory motion of the latch relative to the fastener.

13. The assembly of claim 12, wherein both of the opposed members on the latch have an elongate slot defined therein.

14. The assembly of claim 13, wherein both of the opposed members have a shoulder formed on the outer wall at a midportion of the slot.

15. The assembly of claim 12, wherein one of the opposed members on the latch has a round opening defined therein.

16. The assembly of claim 15, wherein the outer wall on the opposed member with the round opening has a shoulder formed thereon.

17. The assembly of claim 12, wherein the neck portion has a narrow portion with an opening defined therein, the opening configured to align with the openings in the opposed members on the latch.

18. The assembly of claim 12, wherein the biasing member is a coil spring disposed around the fastener that attaches the latch to the neck portion of the hook.

* * * * *